United States Patent [19]

Le

[11] Patent Number: 4,890,674

[45] Date of Patent: Jan. 2, 1990

[54] FLAPPER VALVE PROTECTION

[75] Inventor: Nam V. Le, Lewisville, Tex.

[73] Assignee: Otis Engineering Corporation, Carrollton, Tex.

[21] Appl. No.: 285,517

[22] Filed: Dec. 16, 1988

[51] Int. Cl.[4] ..... E21B 34/08; E21B 34/10

[52] U.S. Cl. ..... 166/319; 166/321; 166/322; 251/63.4

[58] Field of Search ..... 166/319, 321, 322, 324, 166/332; 251/63, 63.4, 63.6, 63.5, 62

[56] References Cited

U.S. PATENT DOCUMENTS

| | | | |
|---|---|---|---|
| 3,724,475 | 4/1973 | Ruppel | 251/62 X |
| 3,865,141 | 2/1975 | Young | 166/322 X |
| 3,915,228 | 10/1975 | Gebeler | 251/62 X |
| 3,955,623 | 5/1976 | Aumann | 166/322 X |
| 4,077,473 | 3/1978 | Watkins | 166/323 |
| 4,160,484 | 7/1979 | Watkins | 166/317 |
| 4,161,960 | 7/1979 | Watkins | 137/458 |
| 4,376,464 | 3/1983 | Crow | 166/324 |
| 4,378,847 | 4/1983 | Patel et al. | 166/317 |
| 4,449,587 | 5/1984 | Rodenberger et al. | 166/332 |
| 4,457,376 | 7/1984 | Carmody et al. | 166/332 |
| 4,605,070 | 8/1986 | Morris | 166/380 |

*Primary Examiner*—Hoang C. Dang
*Attorney, Agent, or Firm*—Dennis T. Griggs

[57] ABSTRACT

An improved subsurface safety valve has a flapper plate which is held open by an operator tube, and which can be closed rapidly during high flow operating conditions without damage to the flapper plate or to the operator tube. The operator tube is telescopically coupled within a tubular piston. Retraction of the operator tube relative to the piston is yieldably opposed by a compression wave spring which is interposed between the operator tube and the piston. Telescoping retraction of the operator tube within the piston is limited by engagement of the operator tube against an internal shoulder of the piston. Damage to the flapper closure plate, pivot pin and operator tube is avoided by effectively decoupling the operator tube from the inertia load presented by the hydraulic piston and column of hydraulic control fluid. This is achieved by telescoping retraction of the operator tube within the piston as the flapper plate rotates through the critical throttling region into sealing engagement against the flapper valve seat. Because of its lower inertia, the operator tube is retracted rapidly through the spring housing in response to rotation of the flapper plate, thereby substantially reducing the magnitude of reaction forces which arise during dragging engagement between the flapper plate and the curved edge of the operator tube.

12 Claims, 7 Drawing Sheets

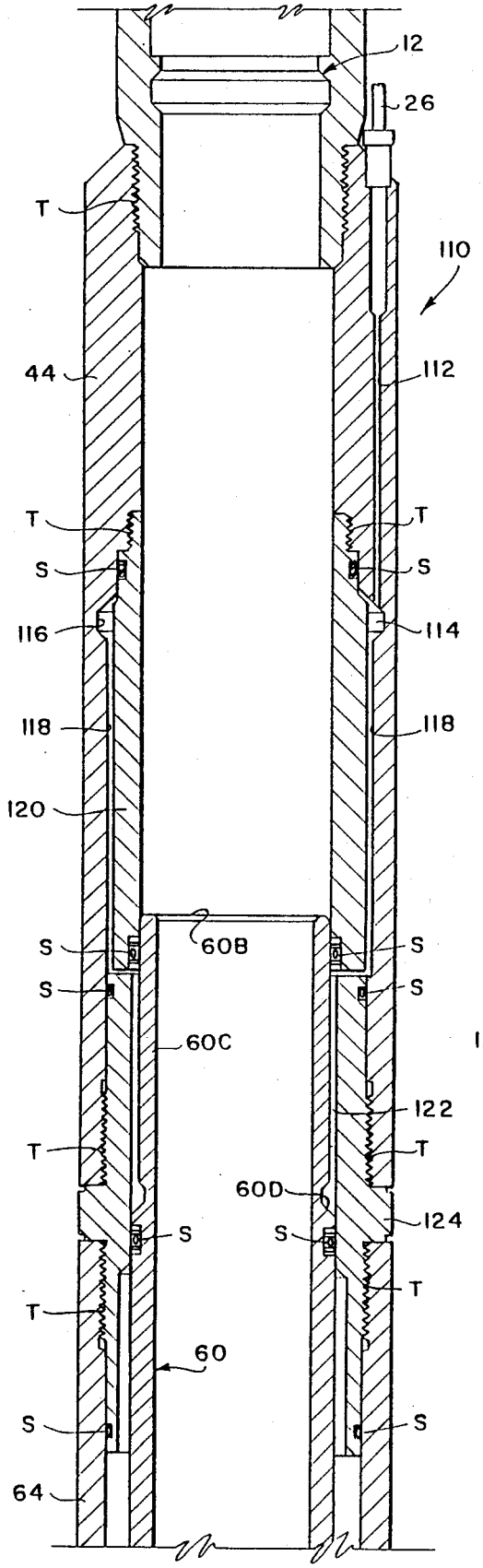
FIG. 12 VALVE OPEN
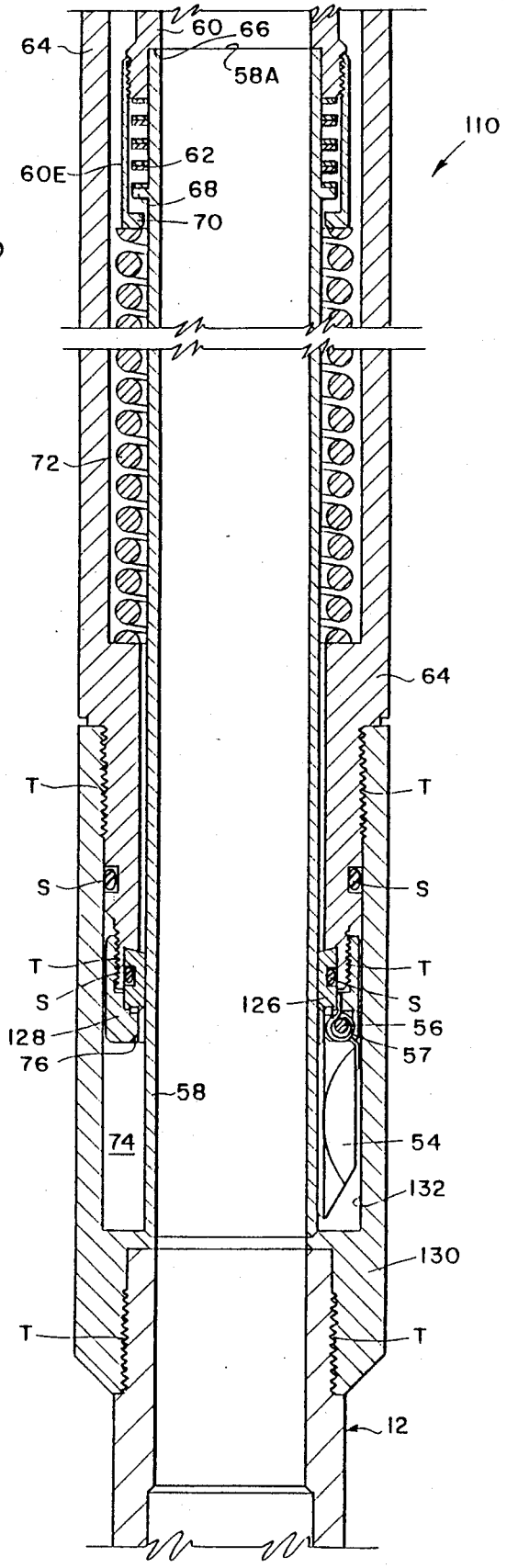
FIG. 13

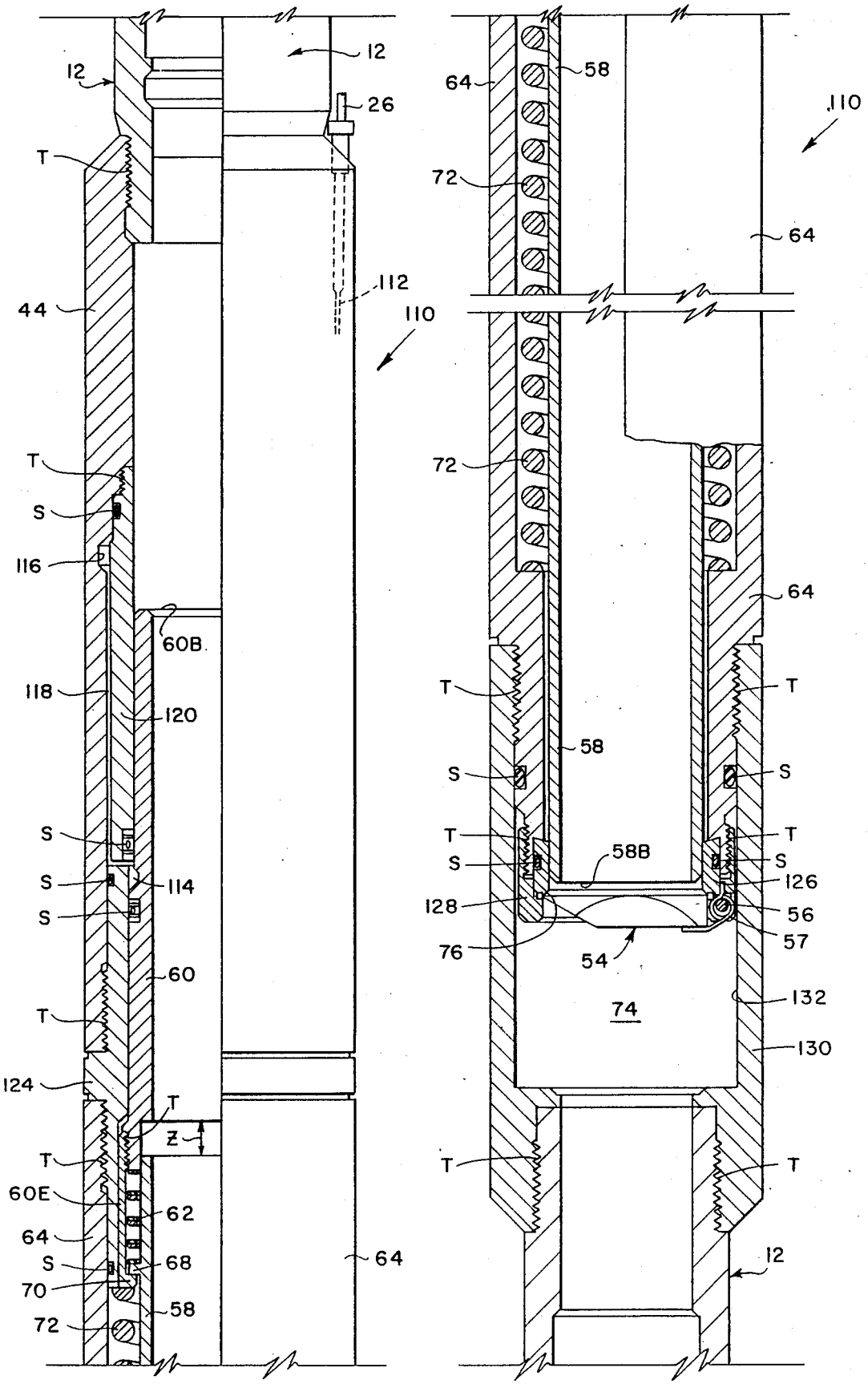
FIG. 14 VALVE CLOSED FIG. 15

FLAPPER VALVE PROTECTION

FIELD OF THE INVENTION

This invention is related generally to safety valves, and in particular to a downhole safety valve which may be installed in a production tubing string and which includes a flapper closure plate for controlling fluid flow therethrough.

BACKGROUND OF THE INVENTION

Formation fluids including oil and gas produced at a wellhead are conveyed through flow lines to remote gathering stations. It is conventional practice to use safety valves which are responsive to certain changes in operating conditions to automatically shut off flow at the surface and below the wellhead at the onset of unusual or unscheduled operating conditions. For example, conventional oil and gas gathering systems include surface and subsurface safety valves which are designed to automatically close in the event of fluctuations either above or below predetermined settings, such as high and low liquid levels, high and low temperatures and electrical power loss. Also, catastrophic failures may occur in which the flow lines and wellhead equipment are destroyed by explosion, fire and the like. Offshore production wells must sometimes be shut off quickly to avoid storm damage. In such situations, it is imperative that well flow be terminated to avoid waste and pollution.

DESCRIPTION OF THE PRIOR ART

Surface controlled subsurface safety valves are commonly used in oil and gas wells to provide downhole protection should a failure or hazardous condition occur at the well surface. Such safety valves are typically fitted into the production tubing and operate to block the flow of formation fluid upwardly through the production tubing. The subsurface safety valve provides for automatic shutoff of production flow in response to one or more well safety conditions that can be sensed and/or indicated at the surface, for example a fire on the platform, high/low pressure condition, high/low temperature condition, and operator override. During production, the subsurface safety valve is held open by the application of hydraulic fluid pressure conducted to the subsurface safety valve through an auxiliary control conduit which is extended along the tubing string within the annulus between the tubing and the well casing.

The safety valve closure member may be a ball, poppet or flapper which is actuated by longitudinal movement of a hydraulically actuated, tubular piston against an operator tube. The flapper valve is maintained in the valve open position by an operator tube which is extended to the valve open position by the application of hydraulic pressure onto the piston. A pump at the surface pressurizes a reservoir which delivers regulated hydraulic control pressure through the control conduit. Hydraulic fluid is pumped into a variable volume fluid chamber and acts against the crown of the piston. When the production fluid pressure rises above or falls below a preset level, the control pressure is relieved and the operator tube is retracted to the valve closed position by a return spring. As the piston and return spring retract, hydraulic fluid in the variable volume fluid chamber and in the control conduit is discharged into a surface reservoir.

In some wells, such as gas wells, a high fluid flow rate of as much as 20 million cubic feet or more per day may be conducted through the production bore of the safety valve. As the tubular piston and operator tube retract, the flapper closure plate throttles the flow as it rotates toward the closed, seated position. A high differential pressure will be developed across the flapper closure plate which can cause damage to the flapper plate as it drags against the operator tube.

The flapper plate is coupled to a hinge pin for pivotal movement through approximately 90 degrees. Because of the combined inertia of the operator tube, the piston and the column of hydraulic fluid, the operator tube and piston will not retract as quickly as the flapper plate can rotate from fully open to fully closed. The total inertia load associated with the operator tube, the piston and column of hydraulic fluid in the control conduit restrains the operator tube so that it functions as a fulcrum as it is engaged by the flapper plate during rotation. As a result of the high pressure differential, the flapper plate and operator tube may become warped, the pivot pin may become warped or broken and the valve housing sub may be damaged or otherwise rendered unserviceable.

Such damage will prevent correct seating and sealing of the flapper plate, and a large amount of formation fuid may be released through the damaged valve, causing waste and pollution. Additionally, during situations involving catastrophic damage to the wellhead, the well flow must be shut off before repairs can be made and production resumed.

The installation or operating depth for flapper valves is limited by the strength of the return spring and the hydrostatic head developed by the column of hydraulic control fluid. As the subsurface depth of the flapper valve is increased, the overall inertia of the operator tube, piston and column of hydraulic control fluid becomes more difficult to overcome.

Representative subsurface safety valves having an upwardly closing flapper plate are disclosed in U.S. Pat. Nos. 4,077,473; 4,160,484; 4,161,960; and, 4,376,464.

OBJECTS OF THE INVENTION

A general object of the invention is to provide an improved subsurface safety valve having a flapper plate closure member which is held open by an operator tube, and which can be closed rapidly during high flow rate operating conditions without damage to the flapper plate or to the operator tube.

A related object of the present invention is to provide a surface controlled, subsurface safety valve having a flapper closure plate which will automatically shut in the well below the earth's surface in the event of damage to the wellhead, flow line or malfunction of surface equipment, with shut in being accomplished safely and effectively by a flapper closure plate under high flow rate conditions.

Another object of the present invention is to provide an improved surface controlled subsurface flapper safety valve in which the overall inertia load presented by the operator tube, piston and column of hydraulic control fluid is effectively decoupled from the flapper plate as it rotates through the critical throttling zone to the valved closed, seated position.

SUMMARY OF THE INVENTION

The foregoing objects are achieved according to the preferred embodiment of the present invention in which a cylindrical operator tube is utilized to hold open a flapper closure plate, with the operator tube being telescopically coupled to a tubular piston. Retraction of the operator tube relative to the piston is yieldably opposed by a compression wave spring which is interposed between the operator tube and the piston. The wave spring undergoes a predetermined amount of compression as the operator tube is retracted relative to the piston, which corresponds with full extension of the piston and operator tube with the flapper plate being held in the open passage position. In the fully extended position of the operator tube and hydraulic piston, the operator tube engages an internal shoulder within the tubular piston, which limits telescoping movement of the operator tube through the piston.

As the hydraulic control pressure is removed from the piston, a return spring drives the tubular piston through the bore of the spring housing. As the end of the operator tub moves longitudinally through the flapper valve chamber, the flapper closure plate drags against the circular edge of the operator tube, with the circular edge of the operator tube presenting a fulcrum surface which is engaged by the flapper closure plate. As the flapper closure plate nears an angular position within the flapper valve chamber where significant throttling action occurs, the tubular piston is driven by the return spring upwardly through the spring housing relative to the operator tube, thus relieving compression of the wave spring. After a predetermined displacement of the piston relative to the operator tube, a coupling shoulder formed on the piston engages a coacting coupling shoulder formed on the operator tube, with the operator tube being carried by upward movement of the return spring and piston, but with the operator tube being retractable against the wave spring within the piston through a predetermined range of travel.

As the valve closure plate moves through the region of the flapper valve chamber where substantial choking action occurs, high magnitude reaction forces which may damage the flapper closure plate, pivot pin and operator tube are avoided by effectively decoupling the operator tube from the inertia load presented by the heavier hydraulic piston and the column of hydraulic fluid between the piston and the hydraulic reservoir. This result is obtained by the telescoping retraction of the operator tube relative to the piston as the flapper plate rotates through the critical throttling region into sealing engagement against the valve seat. Because the inertia of the thin-walled operator tube is substantially less than the inertia of the hydraulic piston and column of hydraulic control fluid, the operator tube will move rapidly without imposing high magnitude reaction forces.

The operator tube will be retracted rapidly against the yieldable wave spring through the spring housing during closure of the flapper plate, thereby substantially reducing the magnitude of reaction forces which arise along the line of engagement between the flapper plate and the curved edge of the operator tube. Moreover, the force of retraction of the operator tube as it is driven by the flapper closure plate is yieldably restrained by the compression wave spring, thereby limiting the force of impact engagement between the operator tube and piston as the flapper closure plate slams shut.

Accordingly, upon loss of control pressure, the subsurface flapper valve closes the production bore effectively and safely without damage to the flapper plate, its hinge pin or the operator tube. Moreover, the flapper valve can be easily reset to the valve open position merely by restoring hydraulic operating pressure to the piston. Upon pressurization, the piston is extended against the return spring and is driven downwardly relative to the operator tube until the wave spring compression distance has been closed. Upon engagement of the operator tube by the piston, the operator tube is extended against the flapper closure plate, thereby driving it to the valve open position. As the valve open position is reached, the return spring is fully compressed and the wave spring is also fully compressed. Thereafter, the subsurface safety valve is ready for automatic service.

The novel features of the invention are set forth with particularity in the claims. The invention will best be understood from the following description when read in conjunction with the accompanying drawings.

BRIEF DESCRIPTION OF THE DRAWINGS

FIGS. 12 and 13 taken together form a longitudinal view in half section of a tubing retrievable subsurface safety valve embodying the features of the present invention showing the various parts of the tubing retrievable embodiment in the valve open position; and, FIGS. 14 and 15 taken together form a longitudinal view in half section of the tubing retrievable embodiment of FIGS. 12 and 13, with the various parts of the tubing retrievable embodiment being shown in the valve closed position.

DETAILED DESCRIPTION OF THE PREFERRED EMBODIMENTS

Figure 1:
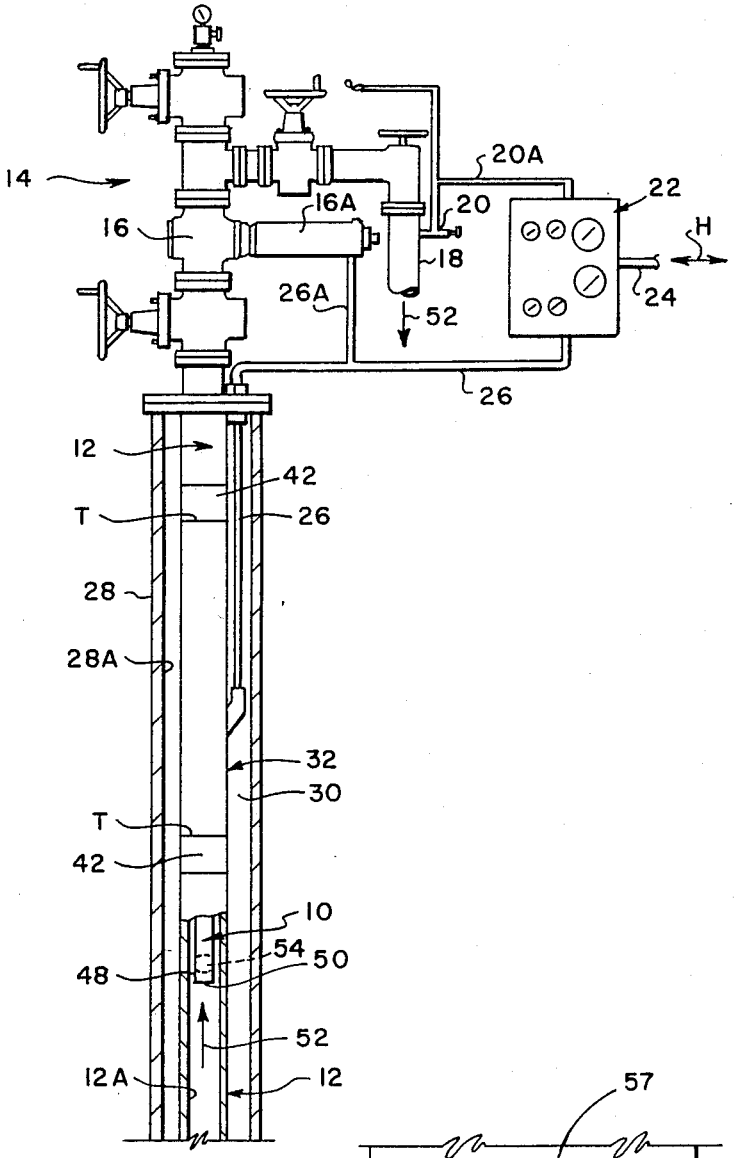
FIG. 1 is an elevation view, partly in section, of a typical production well having a surface controlled subsurface safety valve constructed according to the teachings of the present invention.

In the description which follows, like parts are marked throughout the specification and drawings with the same reference numerals, respectively. The drawings are not necessarily to scale and the proportions of certain parts have been exaggerated to better illustrate details and features of the invention. As used herein, the designation S refers to internal and external O-ring seals and the designation T refers to a threaded union.

Apparatus constructed according to the preferred embodiment of the present invention in the form of a surface controllable subsurface safety valve 10 is shown generally in FIGS. 1–7. Referring first to FIG. 1, the subsurface safety valve 10 is a well safety valve of the wire line retrievable type which is positioned within the bore 12A of a production tubing string 12. The production tubing string 12 is suspended from a wellhead assembly 14 within well casing 28.

The wellhead assembly 14 includes a hydraulically actuated, reverse-acting surface safety valve 16 which is connected in series flow relation with a production flow line 18. Flow line pressure conditions are sensed by a monitor pilot 20. A hydraulic pressure signal 20A produced by the pilot 20 is input to a hydraulic controller 22 which controls flow through a supply conduit 24 which is connected to a hydraulic pump and reservoir (not illustrated). According to this arrangement, flow line pressure conditions are sensed by the pilot 20, and the controller 22 directs pressurized hydraulic fluid through a control conduit 26. The control conduit 26 provides pressurized hydraulic control fluid to the hydraulic actuator 16A of the gate valve 16, and also provides pressurized hydraulic control fluid to the subsurface control valve 10.

The production tubing 12 is suspended from the wellhead assembly 14 within the tubular well casing 28. The control conduit 26 is routed along the production tubing 12 in the annulus 30 between the bore 28A of the well casing and the production tubing string 12.

Figure 2:
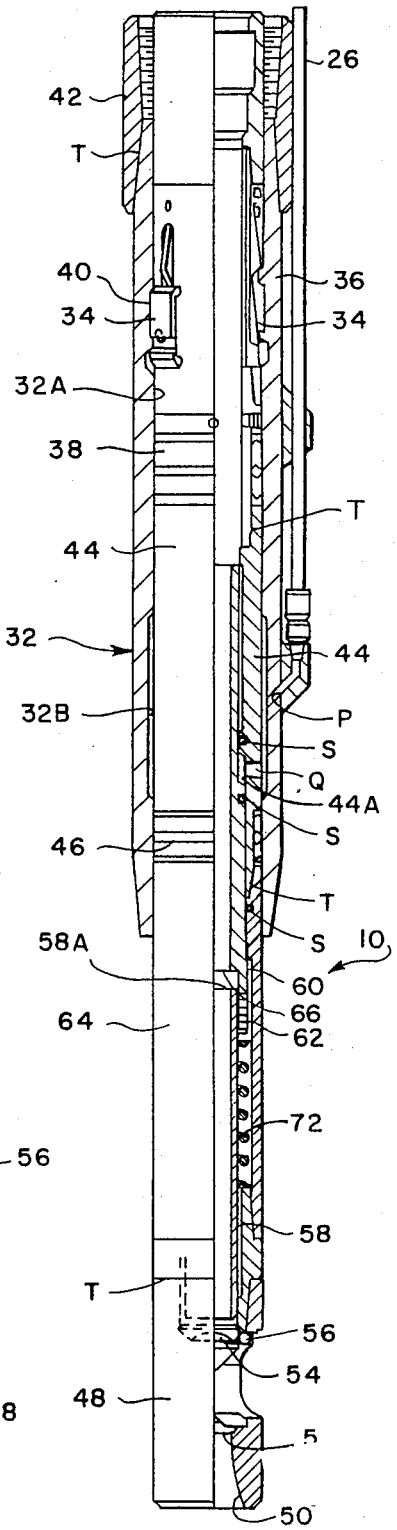
FIG. 2 is an elevation view, partly in section, of the subsurface valve shown in FIG. 1.
Figure 7:
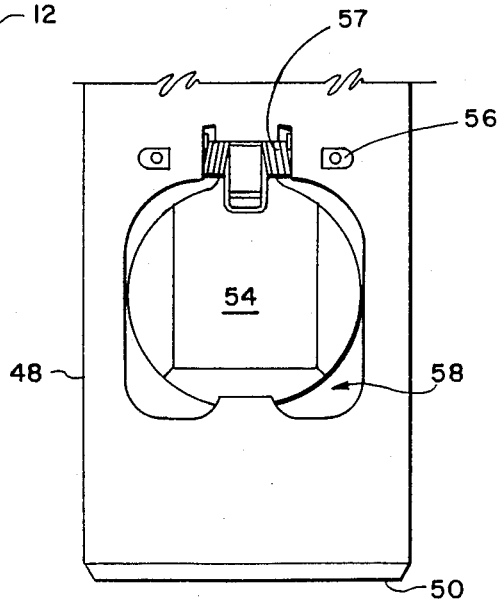
FIG. 7 is an elevation view, partly broken away, of the inlet end of the safety valve which illustrates details of the flapper closure plate.

Referring now to FIG. 2, the surface controllable safety valve 10 is retrievably positioned within the bore of a landing nipple 32 by retractable locking dogs 34 which are mounted on a lock mandrel 36. The annulus between the safety valve 10 and the landing nipple bore 32A is sealed by a V pack seal assembly 38.

The lock mandrel 36 and the safety valve 10 are locked and sealed against the landing nipple 32. The locking dogs are received in detented engagement within an annular slot 40 formed within the inside diameter bore 32A of the landing nipple, with the annulus between the landing nipple bore and the lock mandrel 36 being sealed by the seal assembly 38. The landing nipple 32 is coupled to the production tubing string 12 by threaded coupling collars 42. The upper end of the subsurface safety valve assembly 10 includes a connector sub 44 which is joined to the lock mandrel 36 by a threaded union T. The annulus between the landing nipple bore 32A and the connector sub 44 is sealed by a V pack seal assembly 46. The lower end of the subsurface safety valve 10 includes a valve housing sub 48 which projects into the production tubing bore 12A. The valve housing sub 48 has an inlet port 50 which admits the flow of formation fluid into the production tubing bore 12A for conduction to the wellhead assembly 14 where it is discharged through flow line 18 as shown in FIG. 1.

The valve closure member of the safety valve 10 is a flapper plate 54 which is pivotally coupled to the valve housing sub 48 by a pivot pin 56. The flapper plate 54 is biased for rotational movement to the valve closed position (FIG. 6) by a coil spring 57. In the position shown in FIG. 2 and FIG. 7, the spring bias is overcome and the flapper plate 54 is retained in the valve open position to permit formation fluid flow upwardly through the production tubing string bore 12A to the wellhead assembly 14. The flapper plate 54 is retained in the valve open position by a thin-walled cylindrical operator tube 58.

According to an important feature of the preferred embodiment shown in FIG. 2, the operator tube 58 is telescopically coupled to a tubular piston 60. Retraction of the operator tube 58 relative to the piston 60 is yieldably opposed by a compression wave spring 62 which is interposed between overlapping end portions of the operator tube and piston. The piston 60 and operator tube 58 are enclosed within a cylindrical spring housing 64 which is joined at its lower end to the valve seat sub 48 by a threaded union T, and which is joined at its upper end to the landing nipple 32 by a threaded union T.

The wave spring 62 undergoes a predetermined amount of compression as the operator tube 58 is retracted relative to the piston, which corresponds with the full extension of the piston and operator tube with the flapper plate 54 being held in the open passage position as shown in FIG. 2. In the fully extended position of the operator tube and hydraulic piston, as shown in FIG. 2, the operator tube 58 engages an internal annular shoulder 66 within the tubular piston 60, which limits telescoping travel of the operator tube 58 relative to the piston.

Pressurized hydraulic fluid H is delivered through the control conduit 26 into an inlet port P (FIG. 2) formed in the sidewall of the landing nipple 32. An undercut annulus 32B between the connector sub 44 and the landing nipple bore 32A is filled with pressurized hydraulic fluid H The pressurized hydraulic fluid H is discharged through one or more radial flow ports Q formed in the connector sub 44 into an undercut annulus 44A formed between the tubular piston 60 and the inside diameter bore of the connector sub 44. The pressurized hydraulic fluid H is confined within the undercut annulus 44A by an internally mounted O-ring seal S mounted on the inside diameter bore of the connector sub, and by an external O-ring seal S mounted on the external surface of the tubular piston 60. As the annulus 44A becomes pressurized with hydraulic fluid, the piston 60 is driven downwardly through the spring housing 64, thus extending the operator tube 58 to the valve open position as shown in FIG. 2.

Figure 3:
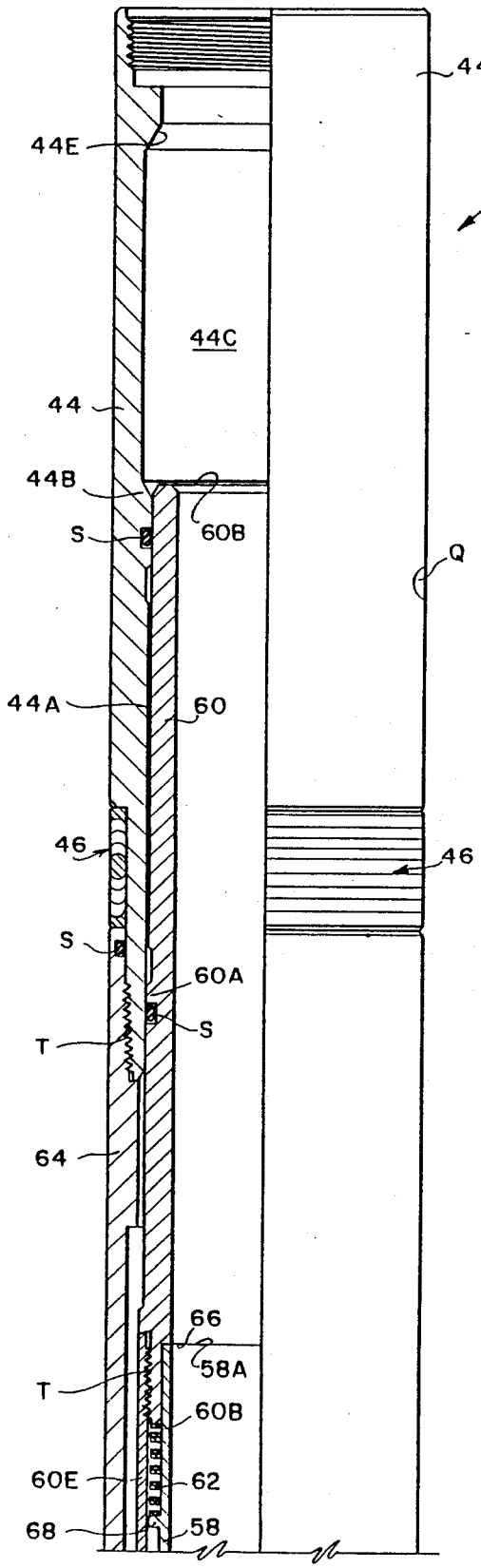
FIGS. 3 and 4 taken together form a longitudinal view in quarter section of a subsurface safety valve constructed according to the present invention, showing the relative position of its component parts in the valve open position.
Figure 4:
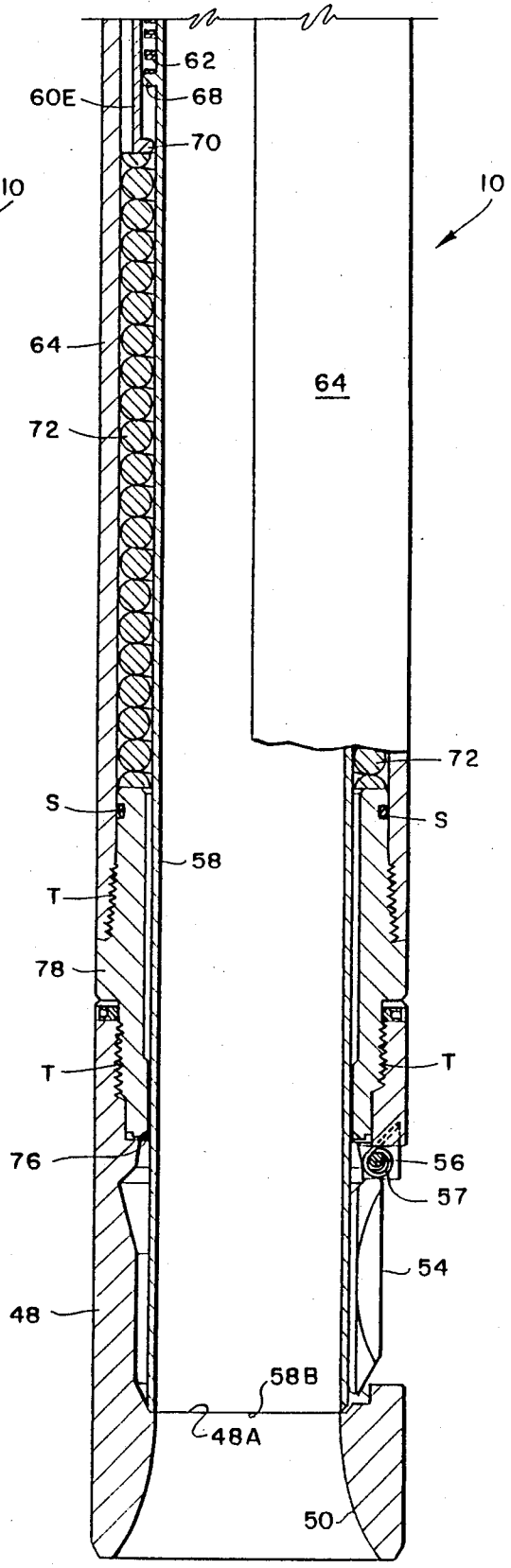

Referring now to FIGS. 3 and 4, the operator tube 58 and the piston 60 are enclosed within the cylindrical spring housing 64. The piston 60 is adapted for slideable, sealing engagement against the inside diameter bore of the connector sub 44 and is disposed in slideable, sealing engagement against the O-ring seal S which is mounted on connector sub shoulder 44A. Likewise, an external O-ring seal S mounted upon on a radially stepped piston shoulder portion 60A bears in sealing engagement against the inside diameter bore of the connector sub shoulder 44B. As the annulus 44A is pressurized with hydraulic fluid H which enters the radial flow port Q, the piston 60 is driven downwardly until its radially stepped shoulder 66 engages the annular face 58A of the operator tube. Continued extension of the piston 60 drives the operator tube 58 into the valve open, open bore position as shown in FIG. 4.

When the operator tube is driven to the valve open position, the wave spring 62 is compressed between a radial shoulder 68 formed on the operator tube and the lower annular face 60B of the piston, and is confined radially between the operator tube 58 and a tubular piston extension 60E. The tubular piston extension 60E is coupled to the piston 60 by a threaded union T. The lower end of the piston extension 60E has a radial flange 70 which is adapted for engagement against the operating tube shoulder 68 during retraction of the piston. Additionally, the radial flange 70 provides an annular surface for engaging the upper end turn of a return spring 72.

In the arrangement shown in FIGS. 3 and 4, the flapper plate 54 is held in the valve open, clear passage position as the operator tube 58 is forced downwardly into engagement on a radially stepped shoulder 48A of the valve housing by engagement of the internal annular shoulder 66 of the piston against the upper annular face 58A of the operator tube. Hydraulic control pressure is maintained by the controller 22 until some unusual flow line condition is sensed, or in response to an operator override command. In response t such a condition or command, hydraulic pressure is relieved from the annular piston pressure chamber 44A, with hydraulic fluid being returned to the surface reservoir in reverse flow through the control conduit 26 and supply conduit 24 as the piston 60 is retracted upwardly by the return spring 72.

As the piston 60 is lifted by the return spring 72, the operator tube 58 will remain in its full valve open position until the wave spring 62 is fully expanded and radial flange 70 becomes engaged against shoulder 68, after which the piston and operator tube move upwardly together. At this time, distance Z between the internal annular piston shoulder 66 and the upper annular face 58A of the operator tube will be at its maximum as shown in FIG. 5.

Figure 5:
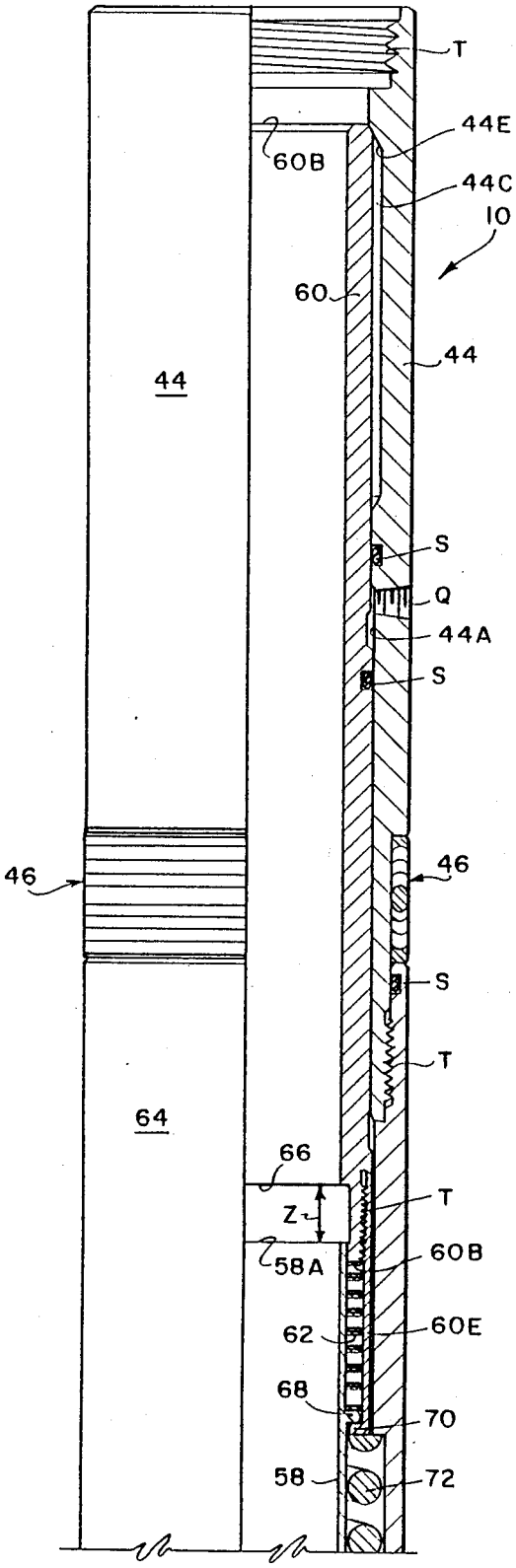
FIGS. 5 and 6 taken together form a longitudinal view in quarter section of a subsurface safety valve embodying the features of the present invention showing the various parts of the safety valve in the valve closed position.
Figure 6:
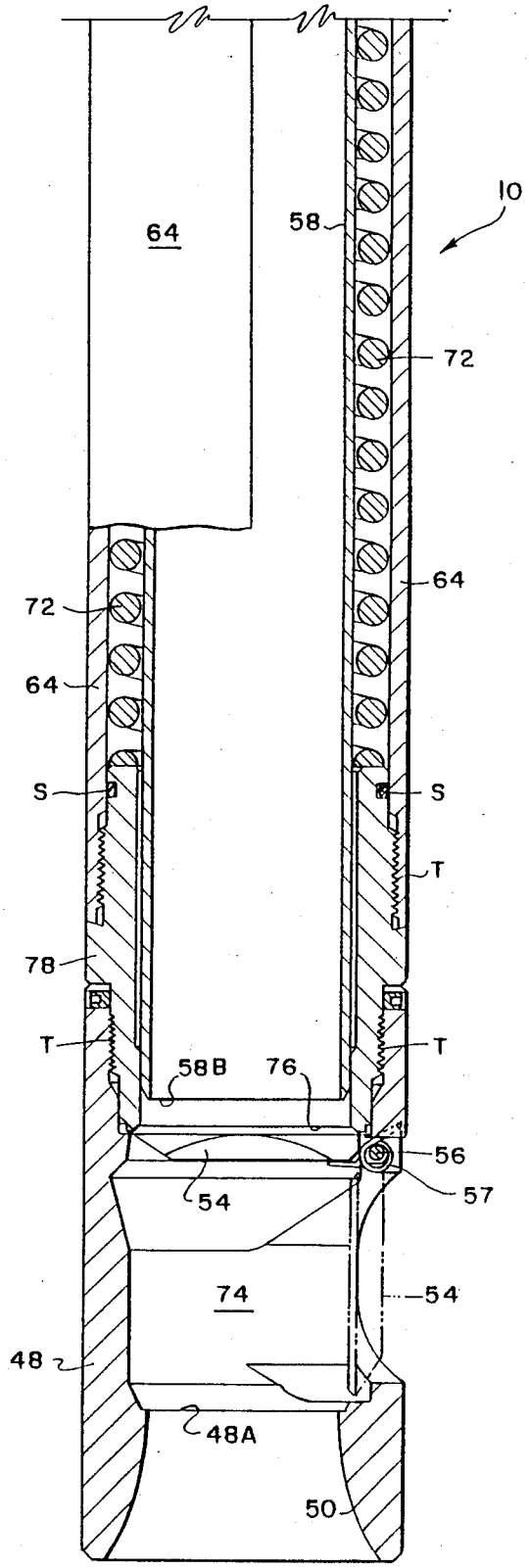

Referring now to FIGS. 5 and 6, as the lower end 58B of the operator tube 58 is retracted longitudinally through the flapper valve chamber 74, the flapper closure plate 54 will begin rotation through chamber 74 and will drag against the circular edge 58B of the operator tube, with the circular edge 58B presenting a fulcrum surface on which reaction forces are concentrated. As the flapper closure plate 54 nears an angular position within the flapper valve chamber where significant throttling or obstructing of fluid flow occurs, the tubular piston and operator tube continue to be driven by the return spring 72 upwardly through the spring housing.

As the valve closure plate 54 moves further through the region of the flapper valve chamber 74 where substantial throttling action occurs, the high magnitude reaction forces which could damage the flapper closure plate, pivot pin and operator tube are avoided by effectively decoupling the operator tube from the inertia load presented by the larger hydraulic piston and the column of hydraulic fluid between the piston and the surface reservoir. This result is obtained by the telescoping retraction of the operator tube 58 relative to the piston 60 through the longitudinal travel range Z as the flapper plate 54 rotates through the critical throttling region into sealing engagement against an annular valve seat 76 formed on the lower end of valve seat sub 78. That is, the inertia of the thin-walled operator tube 58 is substantially less than the inertia of the hydraulic piston 60 and the column of hydraulic control fluid. Accordingly, the operator tube 58 will be retracted rapidly through the travel distance Z within the spring housing 64 during rotational closure of the flapper plate 54, thereby substantially reducing the magnitude of reaction forces which arise at the point of dragging engagement between the flapper plate 54 and the curved edge 58A of the operator tube.

Moreover, the force of retraction of the operator tube as it is driven by the flapper closure plate 54 is yieldably cushioned and restrained by compression of the wave spring 62, thereby limiting the force of impact engagement between the operator tube 58 and piston 60 as the flapper closure plate 54 slams shut against valve seat 76. After the flapper closure plate 54 has shut, the wave spring 62 expands through the distance Z, thereby driving the upper end 60B of piston 60 through connector sub chamber 44C into engagement with shoulder 44E (FIG. 5).

The valve seat 76 is an annular, tapered shoulder formed on the lower end of a valve seat sub 78. The valve seat sub 78 is interposed between the return spring housing 64 and the valve housing sub 48, and is connected thereto by threaded unions T, respectively.

Accordingly, upon loss of surface control hydraulic pressure, the safety valve 10 is closed quickly and safely without damaging the flapper plate, its hinge pin 56 or the operator tube 58, even under high flow rate conditions. Thus, the closure plate 54 will automatically shut in the well below the earth's surface in event of damage to the wellhead 14, flow line 18 or malfunction of other surface equipment, so that repair operations can be carried out safely and production operations can be resumed after the emergency is over. Effective closure of the flapper plate 54 under high flow rate conditions is achieved, without damage, by effectively reducing the inertia load presented by the operator tube, piston and hydraulic column by permitting the operator tube 58 to slip and telescope in retraction relative to the heavier piston 60 as the flapper plate 54 rotates through the critical throttling region within the flapper valve chamber 74. By this arrangement, the inertia load of the piston 60 and of the column of hydraulic control fluid is effectively removed from the operator tube 58, so that the flapper closure plate 54 drives only the relatively low inertia load of the thin-walled operator tube 58 during movement through the critical throttling region. Thus the magnitude of reaction forces which arise along the line of dragging engagement between the flapper plate 54 and the curved edge 58B of the operator tube is substantially reduced, thereby avoiding warping damage and breakage.

Referring now to FIGS. 8, 9, 10 and 11, a wire line retrievable subsurface safety valve 80 may be used to good advantage for well installations in which hydraulic control pressure is not available or cannot be employed effectively for some reason, for example within deep, high flow rate wells. In this alternative embodiment, the safety valve 80 is not controllable from the surface, and relies instead upon the action of a velocity valve flow restrictor 82 to induce closure of the flapper valve plate 54 in response to a predetermined increase in pressure differential across the safety valve.

The upper end of the wire line retrievable subsurface safety valve 80 includes a top connector sub 82 having an internal thread T for connection to the lock mandrel 36 as previously described. The top connector sub 82 is joined to the bottom connector sub 48 by the cylindrical spring housing 64 and the valve seat sub 78 as previously described in connection with the embodiment shown in FIGS. 2–6.

In this wire line retrievable velocity valve embodiment 80, a piston assembly 84 includes a velocity valve housing 86, a guide tube 88 and a tubular extension 90. The velocity valve flow restrictor 82 is received within a cylindrical bore 92 formed within piston housing 86. The piston guide 88 is attached to the annular piston housing 86 by a threaded connection T. The lower piston extension tube 90 is likewise attached to the piston housing 86 by a threaded connection T. The velocity valve flow restrictor 82 is captured axially within the counterbore 92 by the threaded end portion of piston guide tube 88. The lower end of piston housing 86 has a counterbore 94 in which the upper end portion 58A of operator tube 58 is slideably received in telescoping engagement.

Figure 8:
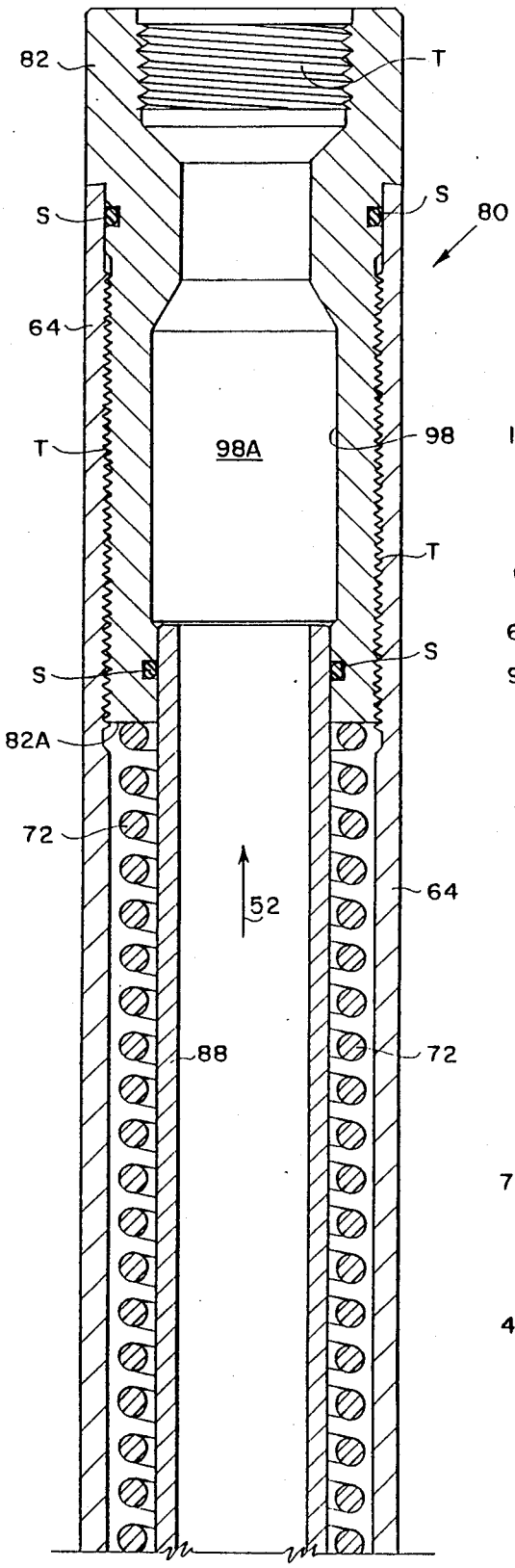
FIGS. 8 and 9 taken together form a longitudinal view in half section of a wire line retrievable safety valve having a velocity valve flow restrictor showing the relative position of its component parts in the valve open position.
Figure 9:
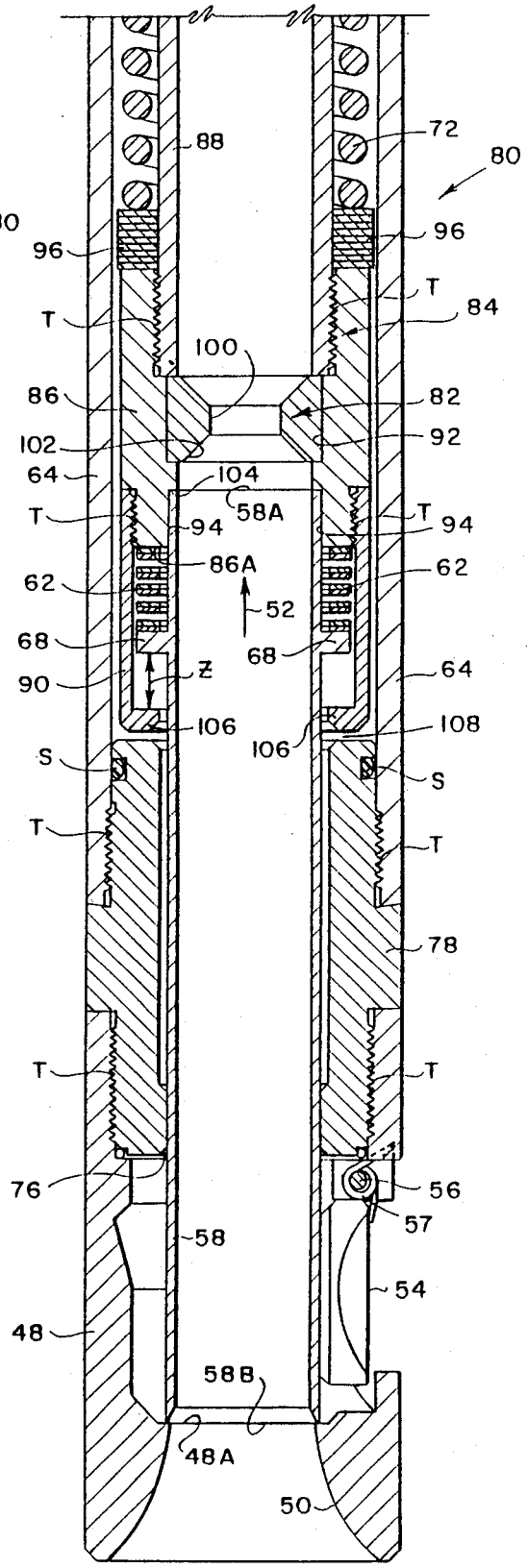

In the valve open position as shown in FIGS. 8 and 9, the operator tube 58 is fully extended and the valve closure plate 54 is retracted out of the chamber 74. The return spring 72 is preloaded by shims 96 to drive the piston assembly 84 downwardly against the upper face 58A of the operator tube, thereby holding the operator tube 58 in the blocking position as shown in FIG. 9. The opposite end of return spring 72 is reacted by the lower face 82A of the top connector sub 82.

The top connector sub 82 has a cylindrical counterbore 98 defining a chamber 98A for receiving the piston guide tube 88 as it is retracted in response to a sudden increase in pressure differential across the velocity valve flow restrictor 82. According to this arrangement, the velocity valve 82 has a bore 100 and an effective flow restriction surface area 102 which are sized appropriately to permit adequate production flow while developing a longitudinally directed force against the surface 102 of sufficient magnitude to drive the piston against the return spring 72 and overcomes its force when the pressure drop across the flow restrictor 82 exceeds a predetermined level.

In the valve open position as shown in FIG. 9, the operator tube 58 is fully extended, and the operator tube is fully inserted within the piston bore 94, with the upper annular piston face 58A being engaged by annular piston flange 104.

The wave spring 62 is interposed between the radial shoulder 68 formed on the operator tube 58 and the lower annular piston face 86A, and is confined radially between the operator tube 58 and the tubular piston extension 90. The lower end of the piston extension 90 has a radial flange 106 which is adapted for engagement against the operating tube annular shoulder 6 during retraction of the piston assembly 84. In the fully extended position (FIG. 9), the operating tube shoulder 68 and radial flange 106 are separated by a gap distance Z. Additionally, in the fully extended, open bore position, the annular piston face 104 is engaged against the upper annular face 58A of the operator tube, and the operator tube 58 is seated against valve housing sub surface 48A. The piston extension tube 90 is dimensioned to provide a small spacing clearance 108 between the flange and the bottom connector sub 78. The wave spring 62 is compressed, and the return spring 72 is fully extended and maintains an extension force on the piston assembly and wave spring as determined by the number of load shims 96.

At the onset of a condition in which the pressure drop across the velocity valve flow restrictor 82 exceeds a predetermined safe operating level, a force arises across the piston assembly which overcomes the extension force developed by spring 72 and causes the piston assembly 84 to retract and the guide tube to be retracted into the top connector sub chamber 98A. Initially, the operator tube 58 remains stationary as the piston assembly is lifted. After the piston assembly has closed the travel distance Z, the operator tube shoulder 68 is engaged by the radial flange 106 of the piston assembly, at which time the wave spring 62 is fully expanded, and the operator tube 58 is retracted along with the piston assembly 84.

As the piston radial flange 106 engages the operator tube shoulder 68, the operator tube 58 begins retraction movement out of the flapper valve chamber 74 as the piston assembly 84 and the operator tube 58 move upwardly together. As the flapper closure plate 54 rotates through the critical throttling region, the high magnitude reaction forces which could damage the flapper closure plate, pivot pin and operator tube are avoided by effectively decoupling the operator tube 58 from the inertia load presented by the larger piston assembly 84 and the load imposed by the bias spring 72.

The foregoing decoupling action is obtained by the telescoping retraction of the operator tube 58 within the piston bore 94 through the longitudinal travel range Z until the wave spring 62 is fully compressed. During movement of the closure plate 54 through the critical throttling region, the low inertia, thin-walled operator tube 58 is driven through the travel distance Z only against the yieldable bias force of the wave spring 62. According to this arrangement, most of the energy associated with driving the operator tube 58 rapidly in retraction is absorbed by the wave spring 62 before the operator tube engages the piston shoulder 86A.

Figure 10:
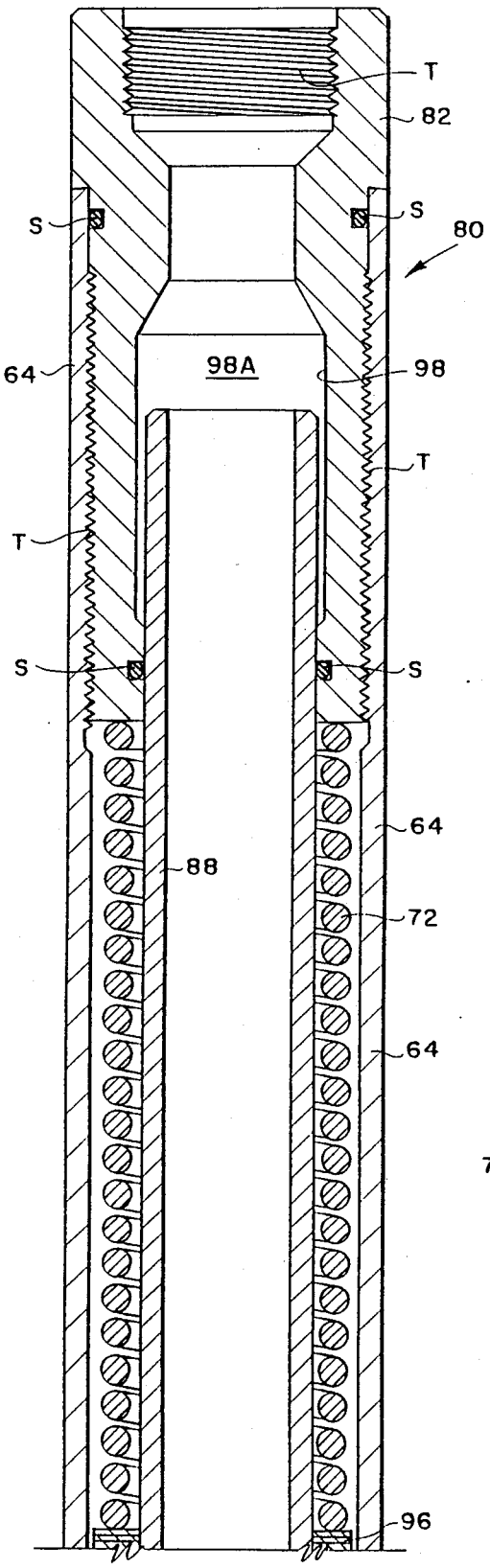
FIGS. 10 and 11 taken together form a longitudinal view in half section of the subsurface safety valve of FIGS. 8 and 9, showing the various components of the wire line retrievable embodiment in the valve closed position.
Figure 11:
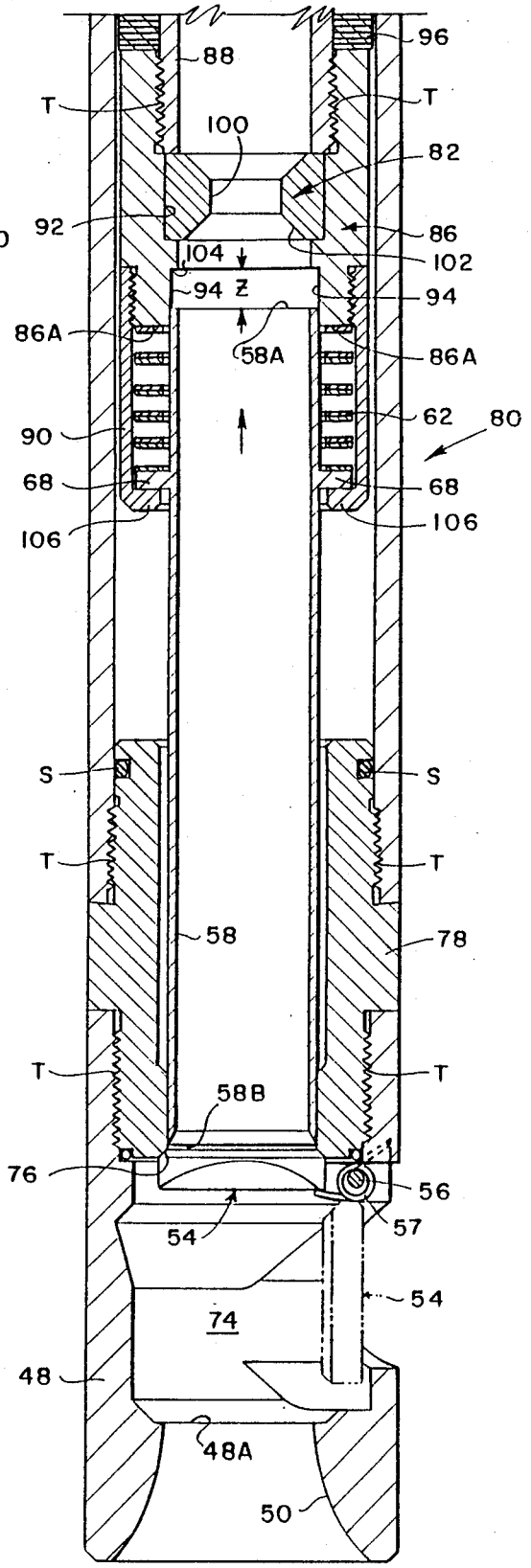

Referring now to FIGS. 10 and 11, the operator tube 58 is fully retracted, the valve flapper plate 54 is sealed against the valve seat 76, the return spring 72 is compressed, and the wave spring 62 is expanded. At the instant the flapper valve plate 54 closes, the flow is terminated and the bias spring 72 will drive the piston shoulder 104 into engagement with the upper end 58A of the operator tube until operator tube shoulder 68 engages piston extension flange 106. The wave spring 62 thereafter remains compressed by the bias spring 72.

Thus the closure plate 54 will automatically shut in the well below the earth's surface in the event of damage to the well head 14, flow line 18 or malfunction of other surface equipment which would cause the pressure drop across the velocity valve flow restrictor 82 to exceed a predetermined safe operating level. After repair operations have been completed, production can be resumed by reopening the flapper valve closure plate 54. This is accomplished by equalizing the pressure across the flapper valve from an external pressure source. As the pressure acting across the flapper plate 54 approaches equalization, the bias spring 72 drives the piston assembly 86 and operator tube 58 to the open bore, valve open position as shown in FIG. 9.

Referring now to FIGS. 12, 13, 14 and 15, a tubing retrievable subsurface safety valve 110 is illustrated. The tubing retrievable safety valve 110 has a relatively larger production bore, and is therefore intended for use in high flow rate wells.

Operation of the tubing retrievable safety valve assembly 110 is substantially the same as the wire line retrievable embodiment shown in FIGS. 2–6 with the exception that the safety valve assembly 10 is connected directly in series with the production tubing 12. Hydraulic control pressure is conducted through the conduit 26 which is connected in communication with a longitudinal bore 112 formed in the sidewall of top connector sub 44. Pressurized hydraulic fluid is delivered through the longitudinal bore 112 into an annular chamber 114 which is in communication with an annular undercut 118 formed in the sidewall of top connector sub 44. An inner housing mandrel 120 is attached to top sub 44 by a threaded connection T, with the undercut 118 defining an annulus between the inner mandrel and the sidewall of top connector sub 44.

The piston 60 is received in slidable, sealed engagement against the internal bore of inner mandrel 120. The undercut annulus 118 opens into a piston chamber 122 in the annulus between the internal bore of a connector sub 124 and the external surface of the piston 60. The external radius of an upper sidewall piston section 60C is machined and reduced to define a radial clearance between the piston and the connector sub 124. An annular sloping surface 60D defines the piston area which is acted against by the pressurized hydraulic fluid delivered through control conduit 26. In FIG. 12, the piston 60 is fully extended with the piston shoulder 66 engaging the top annular face 58A of the operator tube 58. In the valve open position, the wave spring 62 and return spring 72 are both fully compressed.

The flapper plate 154 is mounted onto a valve seat sub 126 which is confined onto the lower end of spring housing 64 by a valve housing sub 128. The lower end of the safety valve 110 is connected to production tubing 112 by a bottom sub connector 130. The bottom sub connector 130 has a counterbore 132 which defines the flapper valve chamber 74. Thus the bottom sub connector 130 forms a part of the flapper valve housing enclosure.

Operation of the tubing retrievable subsurface safety valve 110 is otherwise identical in all respects with the operation of the surface controllable, wire line retrievable safety valve embodiment 10 as illustrated in FIGS. 2–6.

While certain preferred and alternative embodiments of the invention have been set forth for purposes of disclosure, modification to the disclosed embodiments as well as other embodiments thereof may occur to those skilled in the art. Accordingly, the appended claims are intended to cover all embodiments of the invention and modifications to the disclosed embodiment which do not depart from the spirit and scope of the invention.

What is claimed is:

1. A subsurface safety valve adapted to be placed in a well tubing string to control flow therethrough comprising, in combination:

a valve housing having a bore therethrough;

a valve closure member mounted in the housing and movable between an open bore and a closed bore position;

an operator tube movably disposed for longitudinal extension and retraction within said housing for controlling movement of said valve closure member;

a tubular piston movably disposed for longitudinal extension and retraction within said housing for controlling movement of said operator tube;

a return spring interposed between said housing and said piston for yieldably urging said piston for longitudinal retraction movement;

a compression spring interposed between said operator tube and said piston for yieldably opposing longitudinal retraction of said operator tube relative to said piston;

said piston and operator tube having overlapping end portions disposed in telescoping engagement, said compression spring being radially confined between said overlapping end portions; and, mutually engagable coupling means disposed on said pistons and said operator tube, respectively, for limiting longitudinal extension and retraction movement of said operator tube relative to said piston through a predetermined travel range.

2. A subsurface safety valve as defined in claim 1, said mutually engagable coupling means comprising a radially projecting, annular shoulder formed on said piston end portion and a radially projecting, annular shoulder formed on said overlapping end portion of said operator tube end portion, said annular shoulders being engagable at the limit of extension travel of said piston relative to said operator tube.

3. A subsurface safety valve as defined in claim 1, said mutually engagable coupling means comprising a radially stepped shoulder formed on the overlapping end portion of said piston and an annular face formed on the overlapping end portion of said operator tube, said radially stepped shoulder and said annular face being engagable at the limit of retraction travel of said operator tube relative to said piston.

4. A subsurface safety valve as defined in claim 1, wherein said compression spring is a wave spring.

5. A subsurface safety valve as defined in claim 1, including a hydraulic control conduit coupled to said piston, wherein said subsurface safety valve is surface controllable in response to the application of hydraulic control pressure through said conduit onto said piston, said return spring being interposed between said housing and said piston for retracting said piston in response to the removal of hydraulic pressure from said piston.

6. A subsurface safety valve as defined in claim 1, said combination including a tubular landing nipple adapted for connection in said well tubing string, and a lock mandrel releasably attached to the internal bore of said tubular landing nipple, said subsurface safety valve being connected to said lock mandrel, whereby said subsurface safety valve is wire line retrievable.

7. A subsurface safety valve as defined in claim 1, said combination including a top connector sub and a bottom connector sub adapted for connecting said subsurface safety valve in series fluid flow relation in a well tubing string, whereby said subsurface safety valve is tubing retrievable.

8. A subsurface safety valve adapted to be placed in a well tubing string to control flow therethrough comprising, in combination:

a valve housing having a bore therethrough;

a valve closure member mounted in the housing and movable between an open bore and a closed bore position;

an operator tube movably disposed for longitudinal extension and retraction within said housing for controlling movement of said valve closure member;

a tubular piston movably disposed for longitudinal extension and retraction within said housing for controlling movement of said operator tube;

a return spring interposed between said housing and said piston for yieldably urging said piston for longitudinal extension movement;

a compression spring interposed between said operator tube and said piston for yieldably opposing longitudinal retraction of said operator tube relative to said piston;

said piston and operator tube having overlapping end portions disposed in telescoping engagement, said compression spring being radially confined between said overlapping end portions; and mutually engagable coupling means disposed on said piston and said operator tube, respectively, for limiting longitudinal extension and retraction movement of said operator tube relative to said piston through a predetermined travel range.

9. A subsurface safety valve as defined in claim 8, including flow restricting means carried by said piston for restricting flow through said valve housing bore.

10. A subsurface safety valve as defined in claim 9, wherein said flow restricting means comprises a velocity valve flow restrictor having a flow restriction surface member and a flow passage bore formed in said flow restriction surface member, the effective flow restriction surface area and the flow passage bore being sized appropriately to permit adequate production flow while developing a longitudinally directed force of sufficient magnitude to drive said piston against said return spring and overcome its force when the pressure drop across said flow restrictor exceeds a predetermined level.

11. A subsurface safety valve as defined in claim 10, said velocity valve flow restrictor being disposed intermediate said compression spring and said return spring.

12. In a surface controllable subsurface safety valve of the type having a tubular housing, a piston disposed for extension through said housing in response to application of hydraulic control pressure onto said piston, a return spring interposed between said housing and said piston for retracting said piston in response to the removal of hydraulic pressure from said piston, and a valve closure member disposed on said housing having a flapper plate for opening and closing a production flow passage in response to extension and retraction of said piston, respectively, the improvement comprising an operator tube disposed for extension and retraction through said housing, said operator tube and piston having overlapping end portions received in telescoping engagement, the overlapping end portions of said piston and operator tube having mutually engagable coacting coupling means, respectively, for limiting extension and retraction of said operator tube relative to said piston through a predetermined travel range, and a compression spring radially confined between said overlapping end portions for yieldably opposing retraction of said operator tube relative to said piston.

* * * * *